US010071754B2

(12) United States Patent
Hirata et al.

(10) Patent No.: US 10,071,754 B2
(45) Date of Patent: Sep. 11, 2018

(54) RAILCAR WITH BUFFER

(71) Applicant: KAWASAKI JUKOGYO KABUSHIKI KAISHA, Hyogo (JP)

(72) Inventors: Hiroyuki Hirata, Kobe (JP); Ryosuke Ashida, Kobe (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 253 days.

(21) Appl. No.: 14/979,908

(22) Filed: Dec. 28, 2015

(65) Prior Publication Data

US 2017/0183019 A1 Jun. 29, 2017

(51) Int. Cl.
*B61G 11/04* (2006.01)
*B61G 11/18* (2006.01)

(52) U.S. Cl.
CPC ..... *B61G 11/04* (2013.01); *B61G 11/18* (2013.01)

(58) Field of Classification Search
CPC ... B61G 5/00; B61G 5/02; B61G 7/00; B61G 7/10; B61G 7/12; B61G 7/14; B61G 11/00; B61G 11/02; B61G 11/08; B61G 11/10; B61G 11/12
See application file for complete search history.

(56) References Cited

U.S. PATENT DOCUMENTS 5,560,301 A * 10/1996 Smith ..... B61D 3/10 105/21
8,783,479 B2 * 7/2014 Ewerding ..... B61G 7/00 213/221

FOREIGN PATENT DOCUMENTS

JP 3164256 U 11/2010

* cited by examiner

*Primary Examiner* — Robert J McCarry, Jr.
(74) *Attorney, Agent, or Firm* — Studebaker & Brackett PC

(57) ABSTRACT

A railcar according to the present disclosure includes a buffer installed in an end portion of each of coupled cars, and urging each other in a car longitudinal direction, the buffer having a stem movable in the car longitudinal direction and a spring urging the stem, an underframe internally enclosing part of the buffer and including an opening on a top plate of the underframe, and a compression mechanism forcibly compressing the spring to move the stem, part of the compression mechanism being freely brought into and out of the opening.

6 Claims, 13 Drawing Sheets

RAILCAR WITH BUFFER

1. TECHNICAL FIELD

The present disclosure relates to a railcar with a buffer provided in an end portion of each of coupled cars, the buffer that biases the cars in a car longitudinal direction.

2. BACKGROUND

In railcars in which a plurality of cars are coupled to each other, a passenger's way (hereinafter, also simply referred to as a "gangway") is sometimes formed by walkway plates (running boards) and buffer plates such that passengers and crew can move between the cars. The walkway plates are plate members, and each of which is attached to car ends of the car while protruding from the respective car ends. The buffer plates are members each of which has an assisting member overlying the walkway plate in an up and down direction to assist the walkway plate, and an abutment member where the facing buffer plates between adjacent cars are abutted with each other, and supports each walkway plate from its lower side.

Meanwhile, a gap of a coupling part between the cars is displaced when the cars run in a curve section or by acceleration and deceleration of cars in running. The walkway plates and the buffer plates need to move in accordance with the displacement between the cars to ensure the gangway in the case of the displacement of the gap. In particular, when the displacement in the coupling part between the cars is very large, there may be a gap between the walkway plates of the cars. In this situation, the gangway has to be ensured by the assisting members of the buffer plates. At the same time, it is necessary for the buffer plates not to cause a gap between the buffer plates.

Providing buffers having springs with large urging force in end portions of the cars allows the abutment members facing each other between the cars to press against each other in a car longitudinal direction (corresponding to a rail extending direction, hereinafter, simply referred to as the "rail direction") by the buffers. Thereby, assuring no gap between the buffer plates is achieved.

SUMMARY

As described above, each of the buffers is a long assembly along the rail direction, including the spring with large urging force as well as enabling the buffer plate to move in the rail direction.

Due to the above configuration of the buffer, a space needs to be secured so that the buffer is removed from a car body for example for maintenance or the like. This removal operation of the buffer tends to be a labor intensive and time consuming due to the necessity of disconnecting (uncoupling) the cars and moving these cars.

The present disclosure is achieved in order to solve such a problem, and an object thereof is to provide a railcar including a buffer and making the installation and removal of the buffer become more easily.

In order to achieve the object, a railcar according to one aspect of the present disclosure is configured to comprise:

a buffer installed in an end portion of each of coupled cars, and urging each other in a car longitudinal direction, the buffer having a stem movable in the car longitudinal direction and a spring urging the stem;

an underframe internally enclosing part of the buffer and including an opening on a top plate of the underframe; and a compression mechanism forcibly compressing the spring to move the stem, part of the compression mechanism being freely brought into and out of the opening.

According to the above configuration, particularly by providing the underframe having the opening and the compression mechanism, the work for installing and removing the buffer to and from the underframe can be performed without uncoupling the cars or removing a gangway bellows for an gangway. Therefore, by virtue of the present railcar, the buffer can be more easily installed and removed with respect to the car, time and care for the work for installing and removing the buffer can be reduced to a great extent in comparison to the conventional work, and a maintenance property of the buffer can be improved more than the conventional manner.

DETAILED DESCRIPTION OF THE PREFERRED EMBODIMENTS

A railcar with a buffer serving as an embodiment will be described below with reference to the drawings. It should be noted that in the figures, the same or similar constituent components will be given the same reference signs. In order to avoid unnecessary wordiness in the following description and to facilitate understanding of those skilled in the art, detailed description of the already-well-known matters and repetitive description for the substantially identical configurations may sometimes be omitted. Contents of the following description and the attached drawings do not intend to limit the subject matters described in the claims.

Figure 1A:
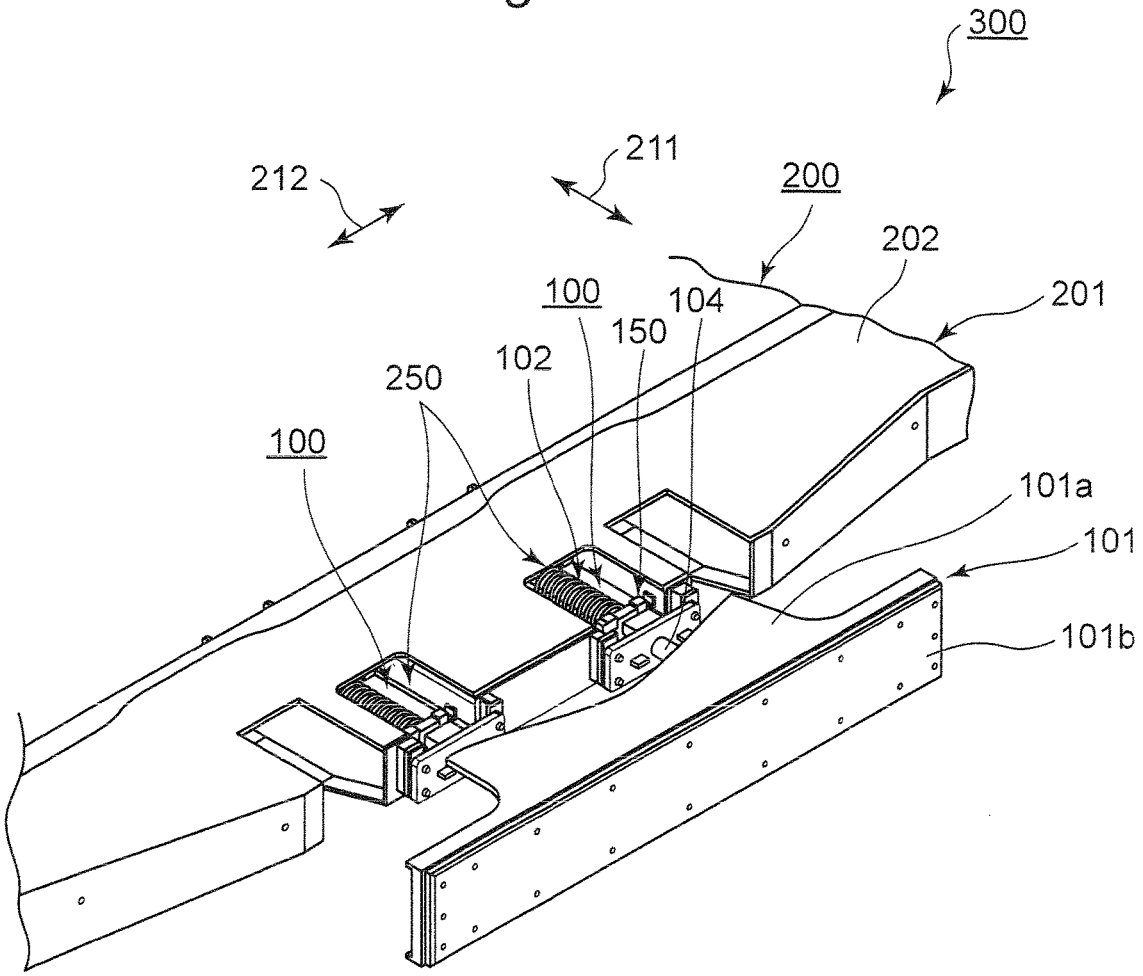
FIG. 1A is a perspective view showing an outline of buffers provided in an end portion in the car longitudinal direction of a railcar in an embodiment, the view showing a state where maintenance openings for the buffers are exposed.
Figure 1B:
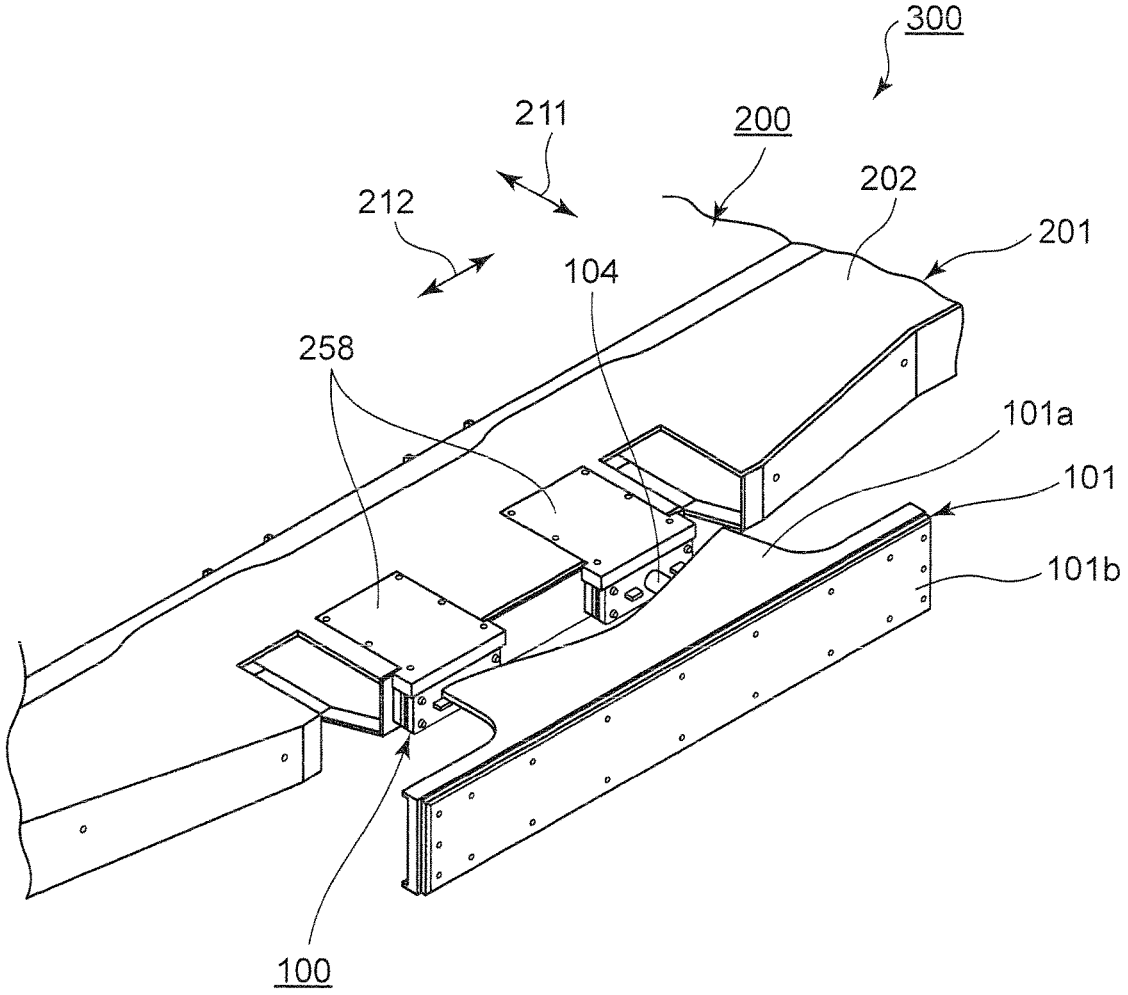
FIG. 1B is a perspective view showing an outline of the buffers provided in the railcar in the embodiment, the view showing a state where the maintenance openings are closed by panels.
Figure 1C:
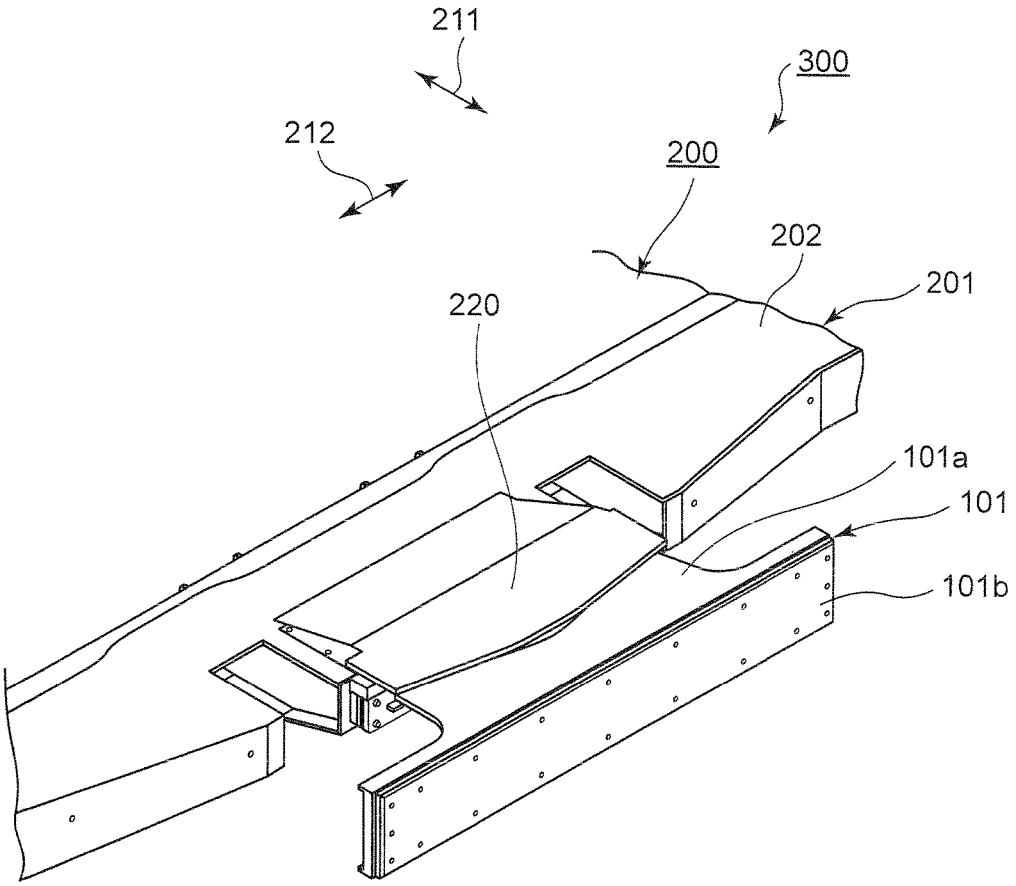
FIG. 1C is a perspective view showing an outline of the buffers provided in the railcar in the embodiment, the view including a walkway plate.

In FIGS. 1A, 1B, and 1C, a railcar 300 includes: an underframe 200 having an end beam 201, the end beam provided in an end portion of the car and extending in a car width direction; buffers 100 installable to and removable from the end beam 201; and compression mechanisms 150. Each of the buffers 100 has a stem 104 to which a buffer plate 101 is attached, and a spring 102 that urges force to the buffer plate 101.

As shown in FIG. 1C, a walkway plate 220 (gangway footplate) is attached on a top plate 202 of the underframe 200 so as to form a gangway. The buffer plate 101 is a member supporting the walkway plate 220 from under the walkway plate, and has an assisting member 101*a* overlying the walkway plate 220 to assist the walkway plate 220, and an abutment member 101*b*. The abutment member 101*b* is abutted with an abutment member 101*b* of the adjacent car.

Figure 3:
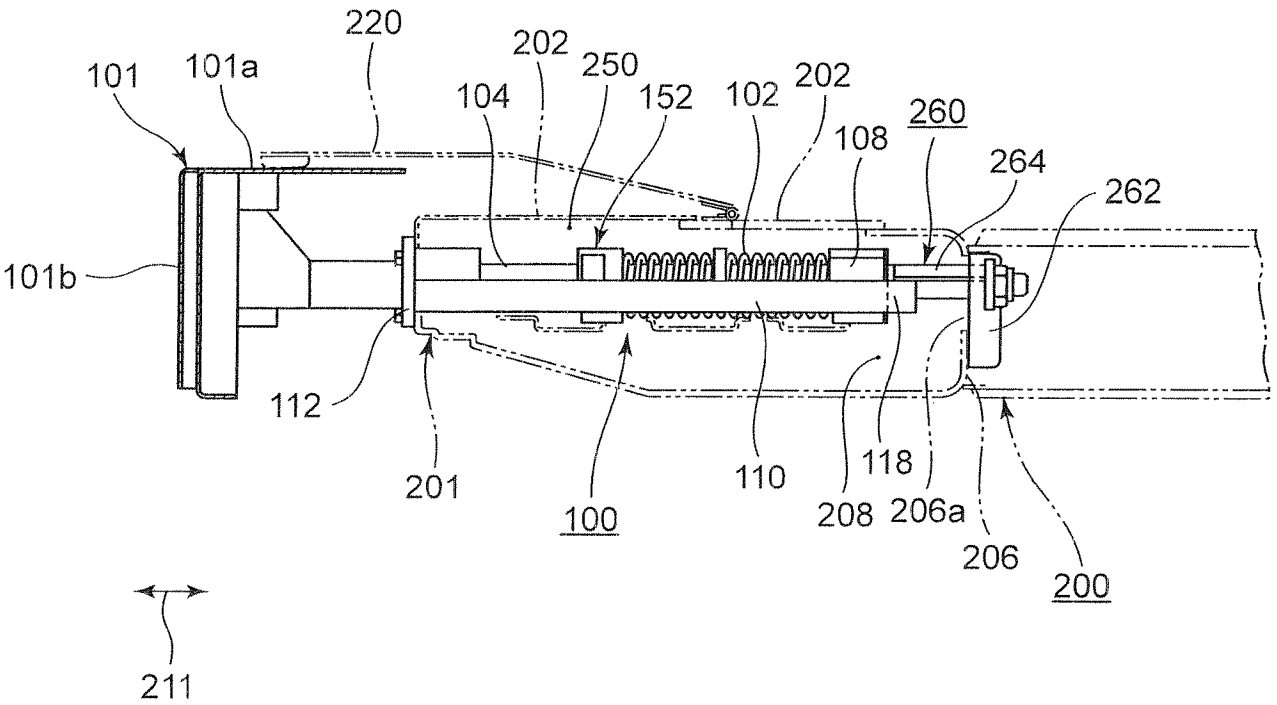
FIG. 3 is a cross-sectional view taken along part A-A shown in FIG. 2.

As shown in FIG. 3, the underframe 200 has the top plate 202 mounted on and fixed to the underframe 200, the top plate having maintenance openings 250. An operator can access each of the compression mechanisms 150 through each of the maintenance openings 250, and can forcibly compress the spring 102 of each of the buffers 100 by the compression mechanism 150.

Figure 2:
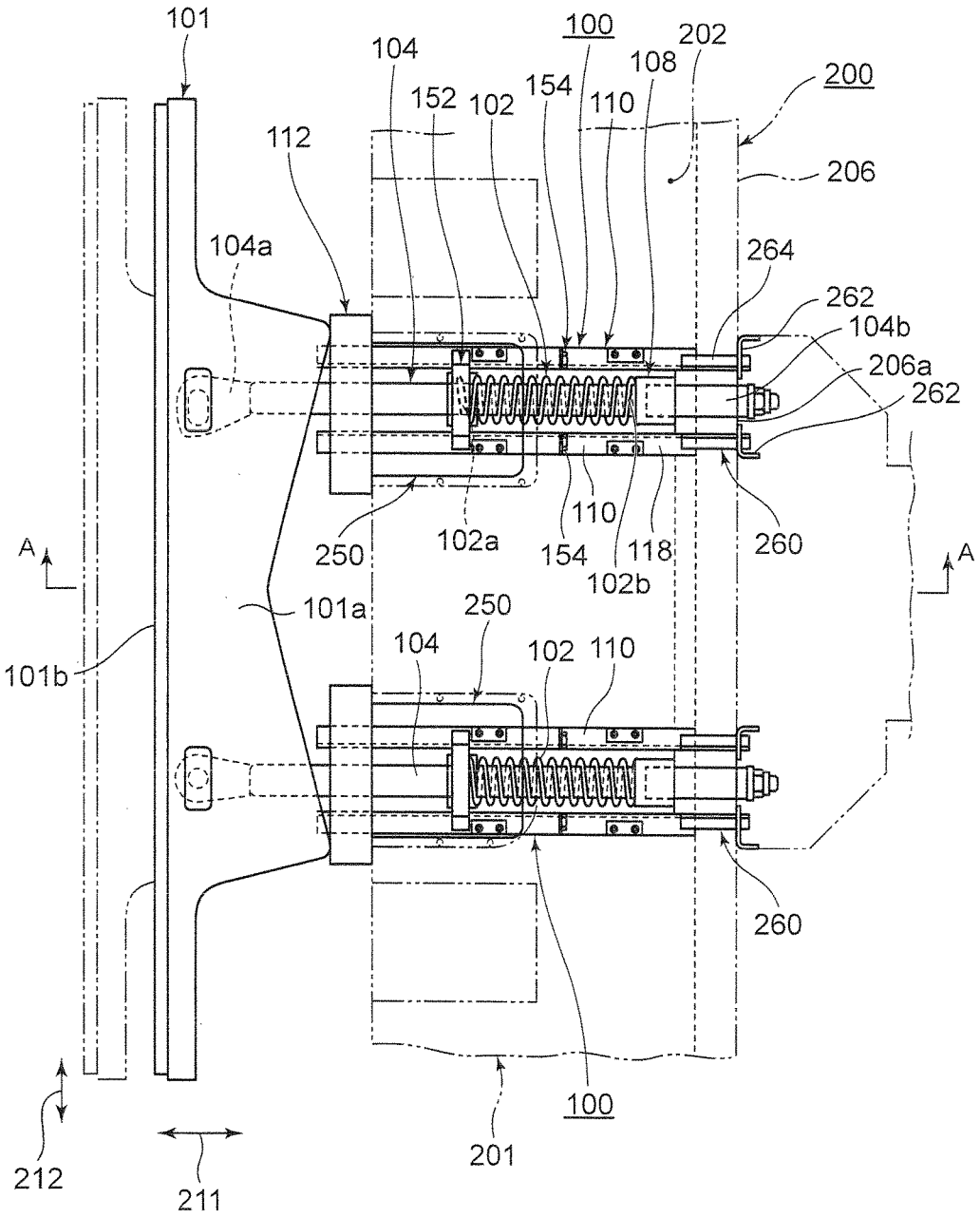
FIG. 2 is a plan view showing a structure of the buffers provided in the railcar in the embodiment.

As shown in FIG. 2, the railcar 300 may further have displacement preventing members 260 in the underframe 200, as a buffer maintenance structure. The displacement preventing members 260 prevent buffer rear end portions 118 corresponding to car body side end portions of the buffers 100 from displacing toward the top plate 202.

Hereinafter, the maintenance openings 250 and the compression mechanisms 150 will be described in detail.

As shown in FIG. 3, the maintenance openings 250 are positioned to face the buffers 100 arranged under the top plate 202. The operator can bring the buffers 100 in and out through the maintenance openings 250. Thus, at a normal time other than a maintenance time, the maintenance openings 250 are closed by panels 258 fixed to the top plate 202 for example by screwing as shown in FIG. 1B.

As described above, the maintenance openings 250 are formed in the underframe 200 serving as a structural member of a floor structure. Thus, an opening area of the maintenance openings 250 has to be a minimum area required for installing and removing the buffers 100.

Next, the compression mechanisms 150 will be described. Each of the compression mechanisms 150 serve as a spring compressor, and includes a front side spring receiving member 152 with holding portions 153, nuts 154 corresponding to one example of a first fastening member, and bolts 156 corresponding to one example of a second fastening member, as basic components.

As shown in FIG. 1A, the pair of buffers 100 is installed to the end beam 201, and the buffers 100 are arranged along a car longitudinal direction 211. It should be noted that both the buffers 100 basically have the same structure. Thus, one of the buffers will be mainly described below.

As shown in FIGS. 2 and 3, the buffer 100 has: the stem 104 supporting the buffer plate 101; a rear side spring receiving member 108; housing members 110; and an attachment member 112, in addition to the above spring 102, as major constituent components thereof. The above front side spring receiving member 152 and the nuts 154 which are basic components of the compression mechanism 150 are also included in the buffer 100.

The attachment member 112 is a plate member for installing the buffer 100 to the end beam 201 by for example screwing bolts from the outside of the car body. A through hole through which the stem 104 passes and is capable of sliding in the car longitudinal direction 211 is formed in the center of the attachment member 112. Further, a pair of housing members 110 is respectively provided on both right and left sides of the through hole in a car width direction 212. In a state where the attachment member 112 is attached on the end beam 201, the housing members 110 on both sides extend in the car longitudinal direction 211. It should be noted that the housing members 110 are connected and fixed to the underframe 200 at appropriate points.

Figure 4:
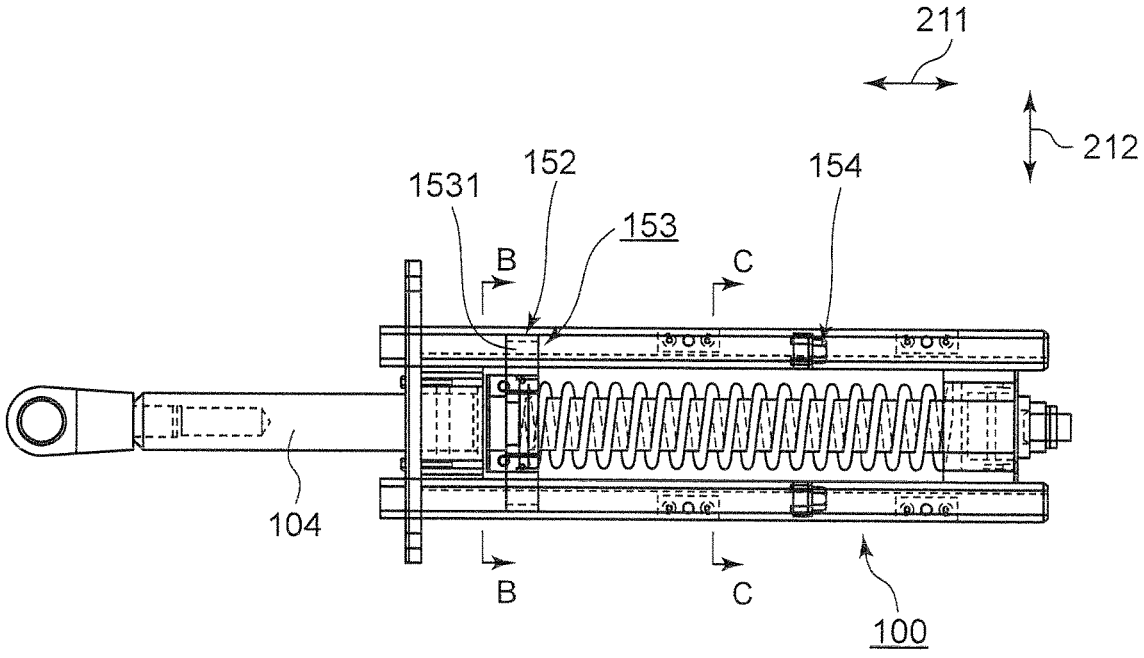
FIG. 4 is a plan view of the buffer shown at the lower side in FIG. 2.
Figure 7:
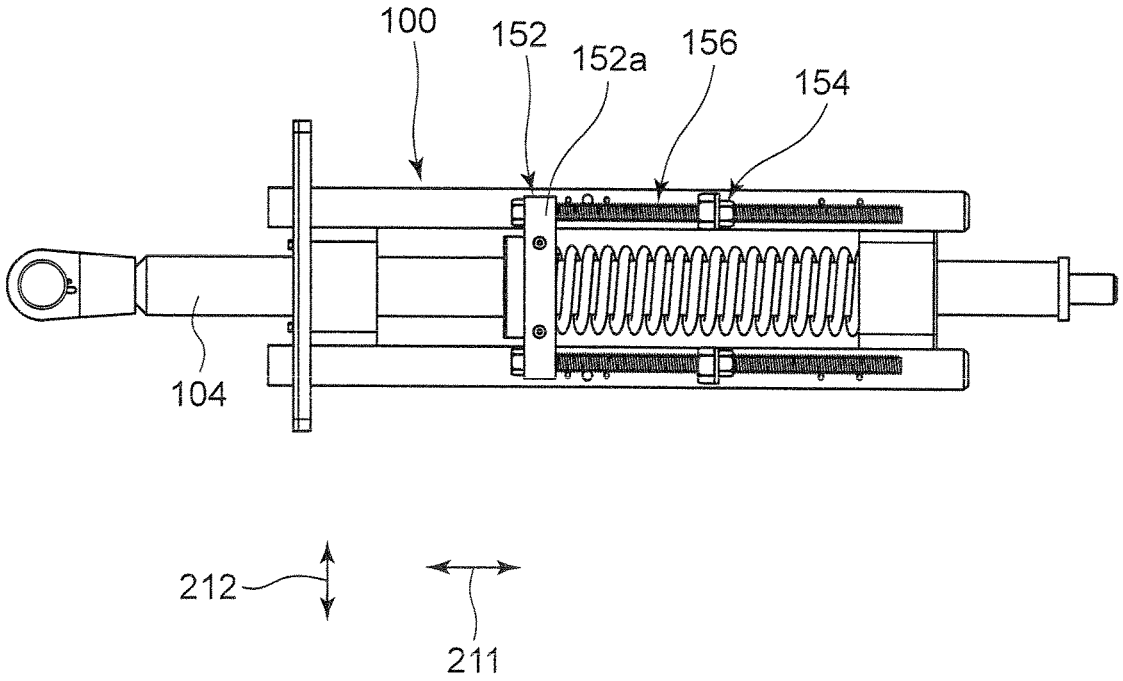
FIG. 7 is a view showing a state where bolts are installed in the buffer shown in FIG. 4, a spring is compressed, and a stem is moved.

As shown in FIGS. 4 and 7, in each of the housing members 110, the nut 154 corresponding to one example of the first fastening member is fixed on the housing member 110. The nut 154 is screwed onto the bolt 156 which is mounted to a groove 1531 described later and corresponding to one example of the second fastening member.

The stem 104 is a shaft member supporting the buffer plate 101 and pressing the buffer plate 101 by the spring 102. As described above, the stem 104 passes through the attachment member 112 and extends in the car longitudinal direction 211. As shown in FIG. 2, one end 104*a* of the stem 104 is positioned on the outside of the end beam 201 in the car longitudinal direction 211, and has a connecting portion for detachably attaching the buffer plate 101.

Meanwhile, the other end 104*b* of the stem 104 is inserted into the spring 102 as a coil spring after passing through the center of the attachment member 112. That is, the stem 104 extends in an inner diameter part of the spring 102, and the spring 102 and the stem 104 are arranged concentrically with each other. As used herein, one end 102*a* is referred to as a part of the spring 102 closer to the attachment member 112, while the other end 102*b* is referred to as an opposite part of the spring 102. The front side spring receiving member 152 is provided on the side of the one end 102*a* and the rear side spring receiving member 108 is provided on the side of the other end 102*b*.

The front side spring receiving member 152 is fixed to the stem 104, whereas the rear side spring receiving member 108 is fixed to both the housing members 110. The rear side spring receiving member 108 and the housing members 110 may be integrally formed or may be formed by separate members. The stem 104 passes through the rear side spring receiving member 108 fixed to the housing members 110.

Figure 5:
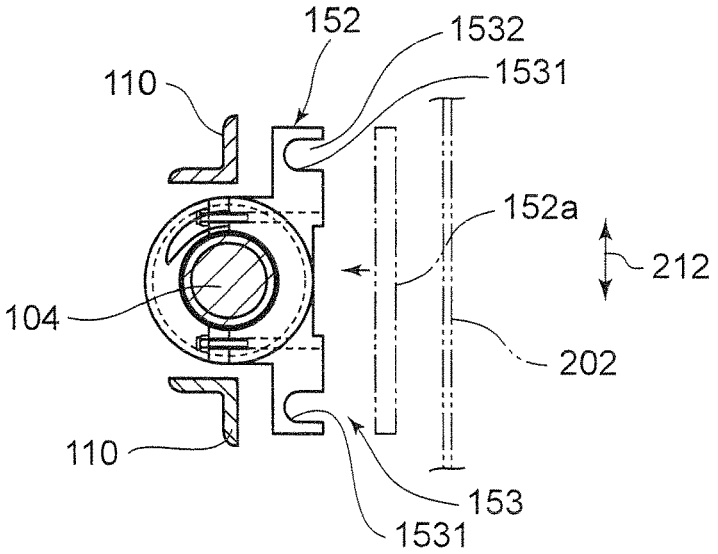
FIG. 5 is a cross-sectional view taken along part B-B shown in FIG. 4.
Figure 6:
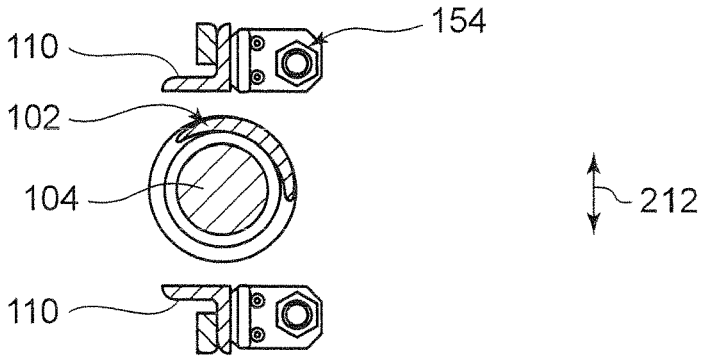
FIG. 6 is a cross-sectional view taken along part C-C shown in FIG. 4.

As shown in FIGS. 4, 5, and 7, the front side spring receiving member 152 has the holding portions 153 on both sides of the front side spring receiving member 152 in the car width direction 212. The holding portions 153 are portions holding the bolts 156 on the front side spring receiving member 152. It should be noted that the bolts 156 are carried in through the maintenance openings 250 in the top plate 202 by the operator. In the present embodiment, the holding portions 153 correspond to the grooves 1531 provided on both sides of the front side spring receiving member 152, the grooves extending in the car longitudinal direction 211. As clear from FIG. 5, the grooves 1531 have open ends 1532 facing the top plate 202 of the underframe 200. Therefore, the bolts 156 carried in from above the grooves 1531 can be mounted. The bolts 156 are thin and long bolt extending in parallel to the spring 102. After the bolts 156 are mounted in the grooves 1531, in order to prevent the bolts 156 from dropping off the grooves 1531, a panel 152*a* (FIG. 5) functioning as a holding member for the second fastening member can be attached onto the front side spring receiving member 152.

It should be noted that the holding portions 153 may be provided not on both sides of the front side spring receiving member 152 but the holding portion may be provided on any one of the sides.

The holding portions 153 is not limited to the groove but may take any configuration that those skilled in the art can anticipate in accordance with a configuration of the second fastening member.

Based on the above configuration, the other end 102*b* of the spring 102 is held by the rear side spring receiving member 108, and the one end 102*a* of the spring 102 is movable along the car longitudinal direction 211 together with the front side spring receiving member 152, that is, the stem 104. Namely, the buffer 100 can compress and restore the spring 102 via the stem 104.

Therefore, by forcibly moving the front side spring receiving member 152 against the urging force of the spring 102 in the car longitudinal direction 211 in a state where the buffer 100 is fixed to the end beam 201, the stem 104 can be moved so that the stem is drawn toward the inside of the underframe 200.

An outline of a procedure of compressing the spring 102 will be described. Firstly, the operator mounts the bolts 156 in the grooves 1531 of the buffer 100 through the maintenance opening 250. Then, after attaching the panel 152*a* onto the front side spring receiving member 152, the operator rotates and screws the bolts 156 into the nuts 154 fixed to the housing members 110. Thereby, fastening with the nuts 154 and the bolts 156 causes the front side spring receiving member 152, that is, the stem 104, and further the buffer plate 101 to be moved in the direction in which the spring 102 is compressed.

It should be noted that in one of the buffers 100 (for example, the buffer shown at the upper side in FIG. 2), the one end 104*a* of the stem 104 has a long hole in the car width direction 212, as an attachment portion for the buffer plate 101. The other buffer 100 has a circular hole. Providing the long hole allows the stem 104 and the buffer plate 101 to relatively displace, and avoid stress applied to the stem 104, when the coupled cars run in a curve section.

In the present embodiment, the front side spring receiving member 152 has two grooves 1531. However, any one of the grooves may only be provided. In accordance with this configuration, the number of the bolts 156 may be one.

In the present embodiment, the nuts 154 are used as the first fastening member and the bolts 156 are used as the second fastening member. However, these may be set in an exchanged manner. That is, bolts are fixed to the housing members 110 along the car longitudinal direction 211 in a state where the bolts extend along the grooves 1531 of the front side spring receiving member 152. Further, by screwing nuts onto the bolts, the front side spring receiving member 152 can also be moved.

In this configuration, the holding portions 153 in the front side spring receiving member 152 may be, for example, through holes instead of the grooves 1531. That is, the above bolts fixed to the housing members 110 may pass through the through holes.

Next, the displacement preventing members 260 will be described.

As described above, removing the attachment of the buffers 100 to the underframe 200 allows the buffers 100 to be drawn out through the maintenance openings 250 during maintenance. In order to enable the buffers 100 to be drawn out, the buffer rear end portions 118 are not fixed to the underframe 200. Meanwhile, a load of passengers going through the gangway is applied at the area in the vicinity of the walkway plate 220 and the assisting member 101*a*. Due to a gradient of a rail track, the coupled cars are relatively displaced in the up and down direction. Thereby, partial contact or the like may be generated between the buffer plates 101. That is, based on the relative displacement in the up and down direction between the coupled cars, only upper portions of the buffer plates 101 are brought into contact with each other and pressed against each other. Therefore, a bending load is generated in the stems 104 of the buffers 100. As a result, a bending load is also generated in the housing members 110. Accordingly, the buffer rear end portions 118 may be displaced toward the top plate 202 of the underframe 200.

Thus, in order to prevent such displacement and enable the buffers 100 to be drawn out, the displacement preventing members 260 are provided on the underframe 200.

Figure 8:
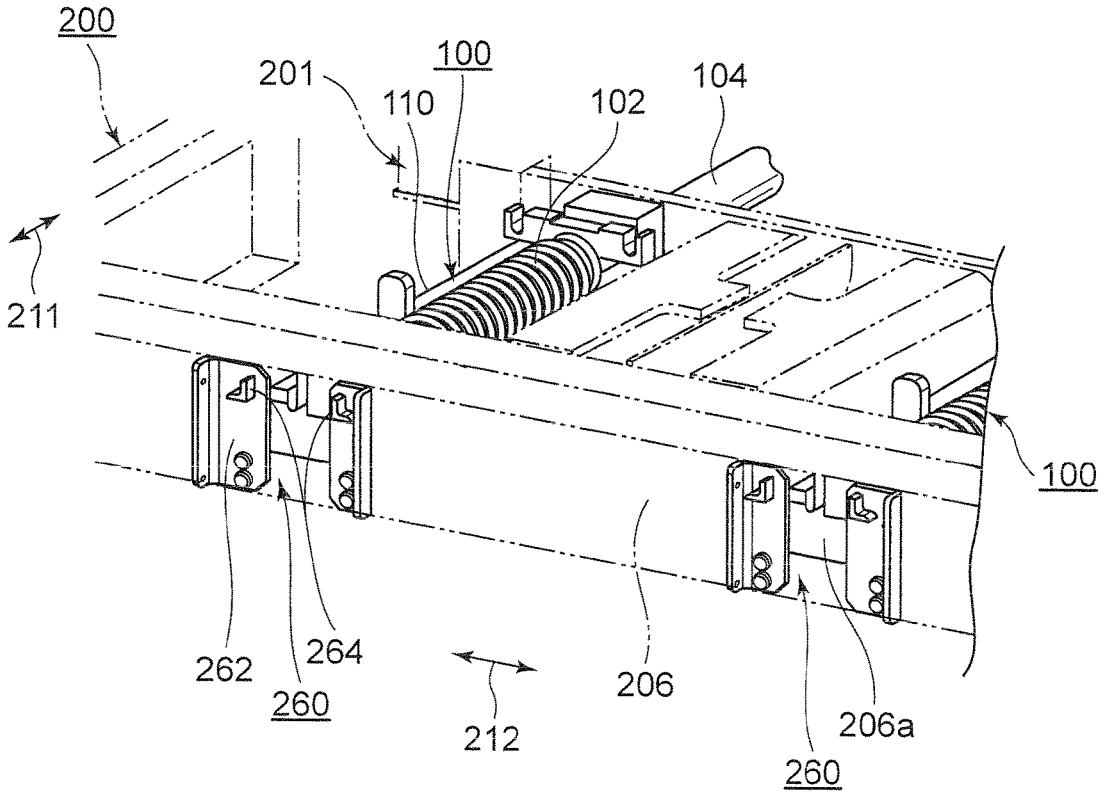
FIG. 8 is a perspective view showing displacement preventing members provided in the railcar in the embodiment, wherein the displacement preventing members prevent displacement of buffer rear end portions.

The displacement preventing members 260 will be described further in detail with reference to FIGS. 2, 3, and 8.

Each of the displacement preventing members 260 has an attachment member 262 and an arm member 264 standing on the attachment member 262, as basic components. In the present embodiment, two sets of displacement preventing members 260 are used for one buffer 100 installed in the underframe 200. The attachment members 262 are attached to the end beam 201 such that the arm members 264 of the displacement preventing members 260 extend in the car longitudinal direction 211, the arm members 264 being positioned in the vicinity of the buffer rear end portion 118. It should be noted that a lateral beam 206 includes an opening 206*a* through which a rear end of the stem 104 movable in the car longitudinal direction 211 can protrude from the end beam 201. The attachment members 262 are attached to peripheral parts of this opening 206*a*.

In such attachment state, in the buffer rear end portion 118 of the buffer 100, an extremely slight clearance is formed between each of the housing members 110 and each of the arm members 264 in the up and down direction.

By virtue of the displacement preventing members 260, as described above, even in a case where the bending load is applied to the housing members 110 and the housing members 110 are warped downward, the housing members 110 and the arm members 264 are abutted with each other at the buffer rear end portion 118. As a result, the displacement of the buffer rear end portion 118 toward the top plate 202 of the underframe 200 is prevented by the displacement preventing members 260.

Figure 9A:
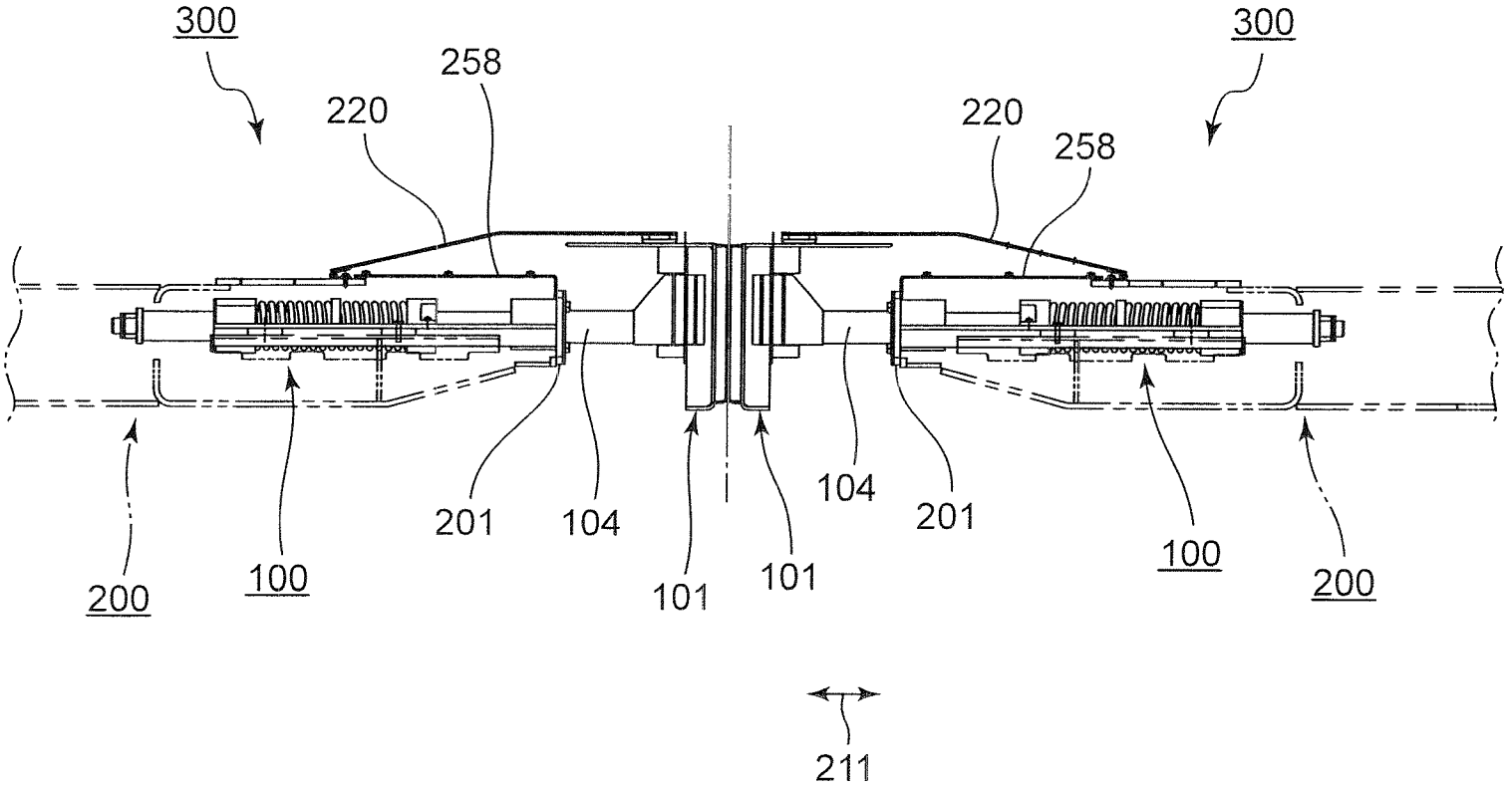
FIG. 9A is a side view showing a coupling part between the railcars in the embodiment, the view showing a state before a work for installing and removing the buffers is started.
Figure 9B:
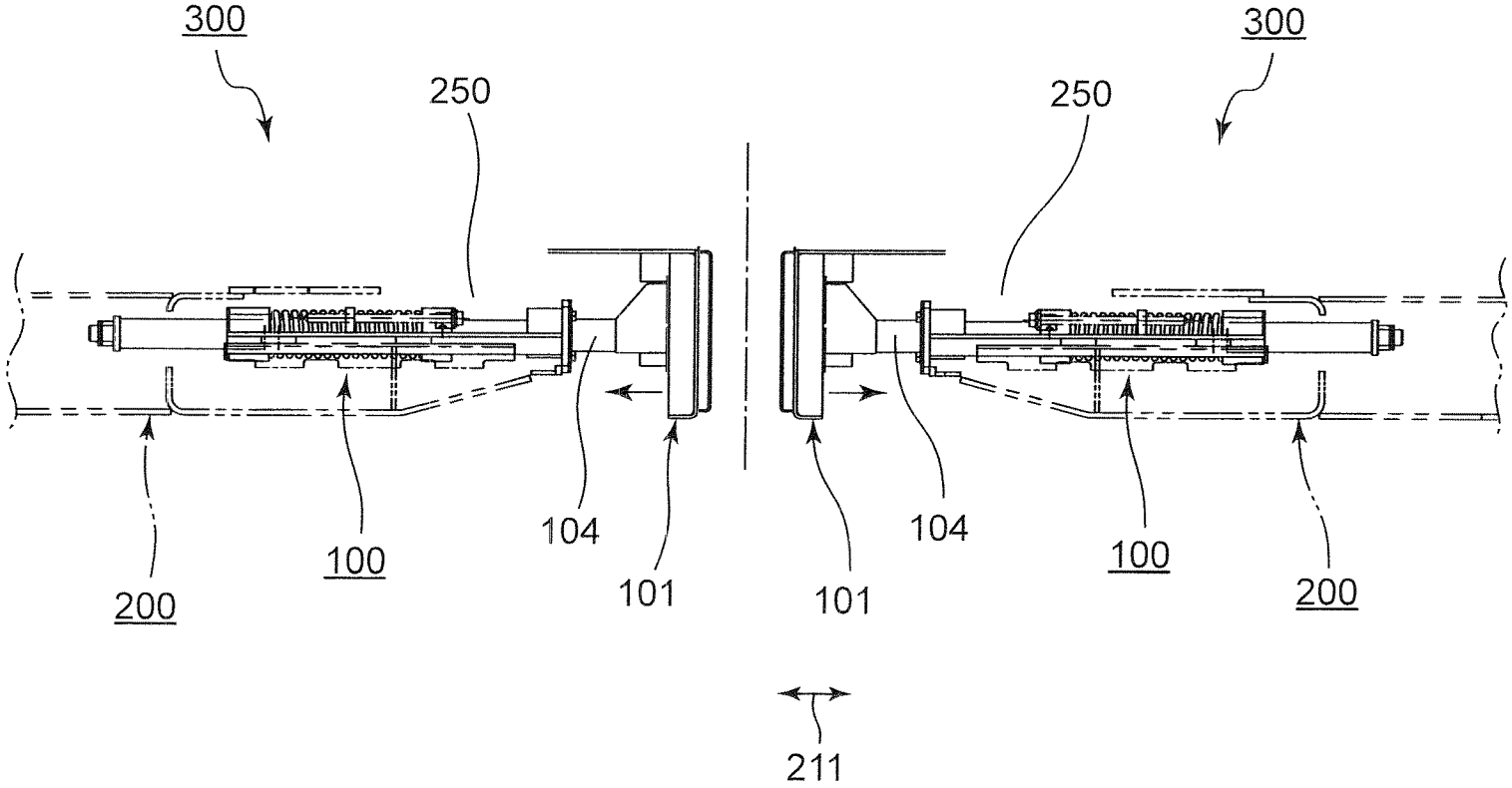
FIG. 9B is a side view showing the coupling part between the railcars in the embodiment, the view showing a state where stems are moved during the work for installing and removing the buffers.
Figure 9C:
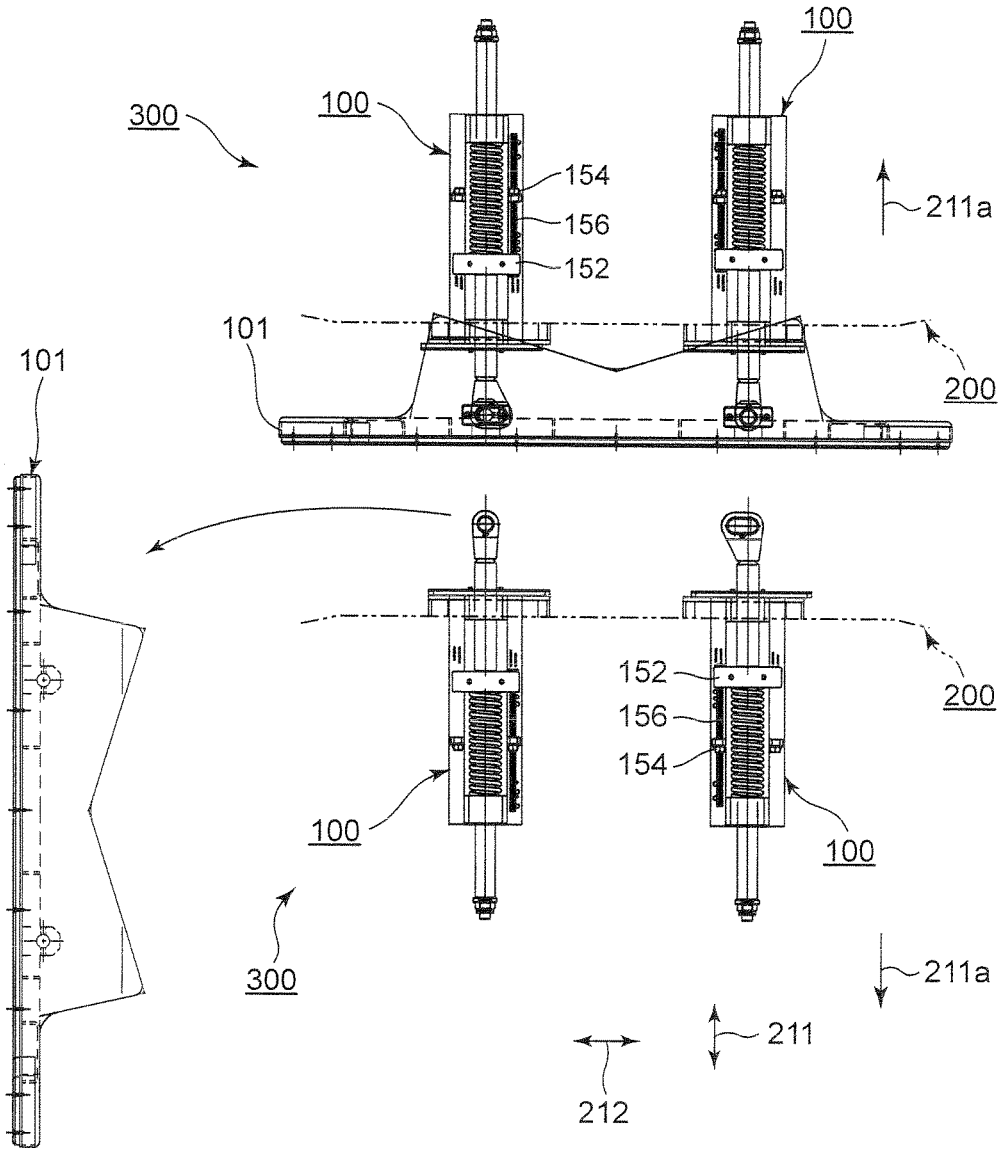
FIG. 9C is a plan view showing the coupling part between the railcars in the embodiment, the view showing a state where the buffer plate is removed during the work for installing and removing the buffers.
Figure 9D:
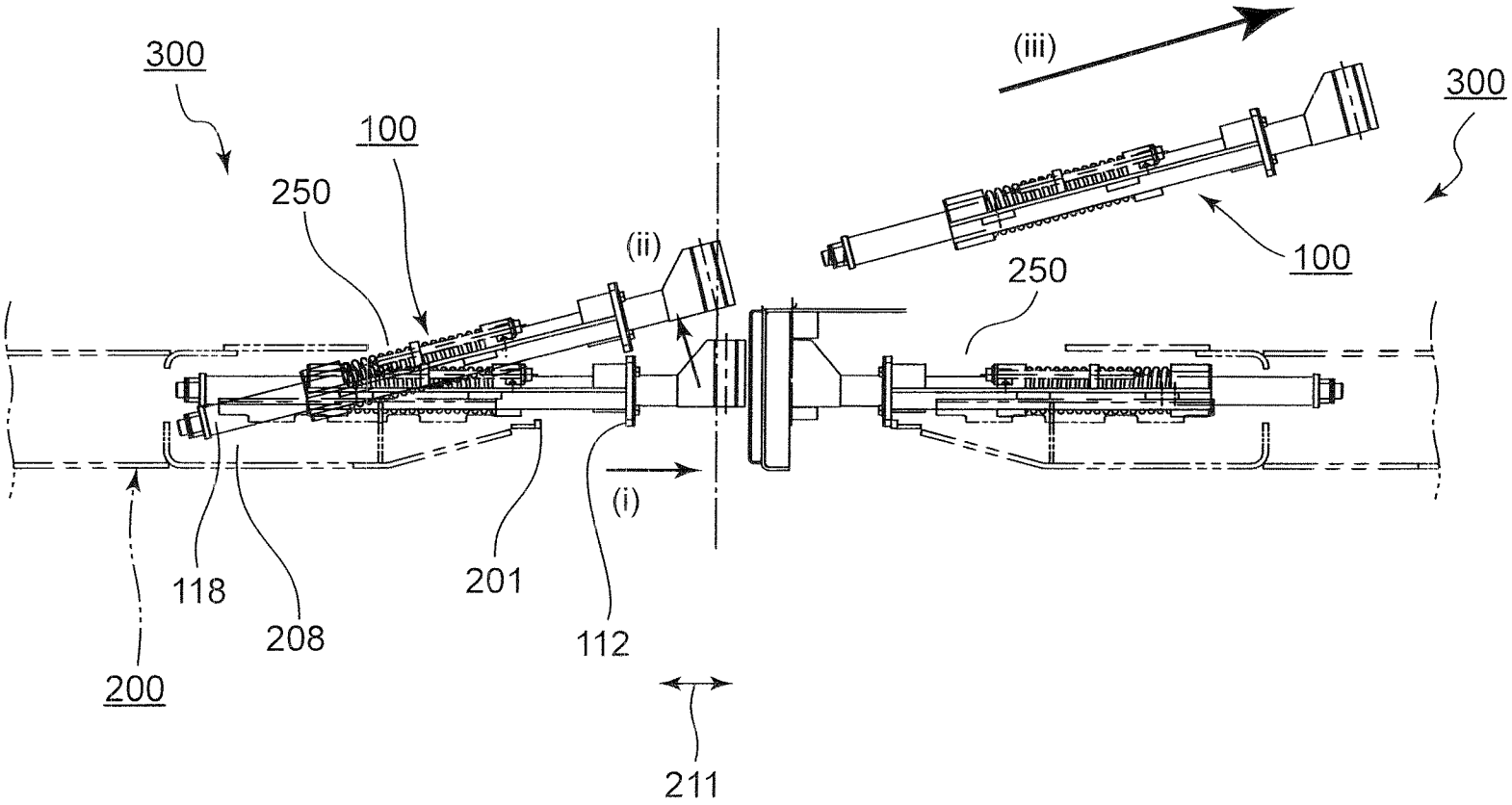
FIG. 9D is a side view showing the coupling part between the railcars in the embodiment, and explaining a method removing the buffers from a underframe in the work for installing and removing the buffers.

Changing the subject, as shown in FIGS. 3 and 9D, there is a non-contact space 208 in the underframe 200 in the vicinity of the buffer rear end portion 118. Thereby, at the time of installing and removing the buffer 100, contact between the buffer rear end portion 118 and members within the underframe 200 is prevented. As a result, the operator can bring the buffer 100 obliquely upward.

Next, with reference to FIGS. 9A to 9D, a procedure of installing and removing the buffer 100 will be briefly described. The procedure is characterized in that the buffers 100 can be installed and removed in a state where the cars remain coupled, by virtue of the structure of the present embodiment.

FIG. 9A is a view showing a state before the buffers 100 are removed from the underframe 200. That is, the buffers 100 installed in the underframe 200 urge force to the buffer plates 101 by the springs 102, and the gangway is formed by the buffer plates 101 and the walkway plates 220.

As shown in FIG. 9B, firstly, the operator detaches the walkway plate 220 and the panels 258 covering the maintenance openings 250 in each of the coupled cars. Thereby, a front side part of each of the buffers 100 in each of the cars, the front side part including the front side spring receiving member 152, is exposed.

Next, the operator mounts the two bolts 156 in the grooves 1531 of the front side spring receiving member 152, attaches the panel 152*a* to the front side spring receiving member 152 in each of the buffers 100, and screws the bolts 156 into the nuts 154. It should be noted that FIG. 9C shows only one bolt 156 in one buffer 100 and the other bolt is omitted in the figure.

Tightening the bolts 156 and the nuts 154 causes the spring 102 to be compressed, and together with the front side spring receiving member 152, the stem 104, that is, the buffer plate 101 to be moved in the direction of an arrow 211*a* in each of the buffers 100. Thereby, the buffer plate 101 of each of the cars is separated away from the other buffer plate and a gap is generated between both the buffer plates. Any of the above works can be implemented inside the car.

Next, as shown in FIG. 9C, after the gap between the buffer plates 101 becomes a specified distance (of, for example, 2 inches or more), the operator removes the buffer plate 101 from the end of the stem 104 in one car, and draws the buffer plate out in the lateral direction of the car body. This work is performed outside the car.

Next, as shown in FIG. 9D, after unfastening attachment parts between the buffer 100 and the underframe 200, the operator firstly slightly moves the buffer 100 forward along the car longitudinal direction 211 as shown by a sign (i). Next, as shown by a sign (ii), in order to prevent the buffer 100 from being abutted with the buffer plate 101 facing the buffer 100 to be removed, the operator raises the buffer 100 obliquely upward. Finally, as shown by a sign (iii), the operator pulls the buffer 100 out obliquely upward through the maintenance opening 250. It should be noted that the series of works shown in FIG. 9D can be implemented inside the car.

Regarding the buffer 100 of the other car, the buffer 100 is pulled out from the underframe 200 by similar works described above.

A work for installing the buffer 100 into the underframe 200 can be performed by a procedure reverse to the above pull-out action.

As mentioned above, in the railcar 300 of the present embodiment, the work can be performed without uncoupling the cars and removing a gangway bellows for the gangway. Therefore, a labor intensive and time consuming for installing and removing the buffer 100 can be reduced to a great extent in comparison with the conventional work, and workability in maintenance can be improved more than the conventional manner.

Further, the railcar with the buffers in the embodiment can adopt the following aspects.

Namely, a railcar may be configured to comprise:

a buffer installed in an end portion of each of coupled cars, and urging each other in a car longitudinal direction, the buffer having a stem movable in the car longitudinal direction and a spring urging the stem;

an underframe internally enclosing part of the buffer and including an opening on a top plate of the underframe; and a compression mechanism forcibly compressing the spring to move the stem, part of the compression mechanism being freely brought into and out of the opening.

In the above aspect, the railcar may be configured to further comprise a gangway footplate serving as a passage between the coupled cars, and a buffer plate overlapping the gangway footplate, the buffer plate being abutted with the adjacent car, wherein the buffer presses the buffer plate in the car longitudinal direction.

Further, the buffer may include: the spring positioned coaxial to the stem; a spring receiving member fixed to the stem and supporting one end of the spring; and a housing member remaining stationary with respect to the movable stem and supporting the other end of the spring. The compression mechanism may include: a first fastening member fixed to the housing member; a second fastening member engaged with the first fastening member; and a holding portion provided in the spring receiving member and holding the second fastening member or the first fastening member. By tightening the first fastening member and the second fastening member, the spring receiving member and the stem are moved together to compress the spring.

Further, the railcar may be configured to further comprise a displacement preventing member preventing a buffer rear end portion from displacing toward the top plate, the displacement preventing member being fixed to the underframe and extending to the buffer rear end portion, with the buffer installed in the end portion of the car.

Further, the opening may be positioned at a front side of the stem in the underframe and formed on an upper surface of the top plate, and the underframe may include a non-contact space where there is no member arranged in contact with a buffer rear end portion when the buffer protrudes from the opening.

Further, the first fastening member may be a nut, and the second fastening member may be a bolt extending in parallel to the spring. Also, the holding portion may be a groove receiving the bolt.

The present disclosure sufficiently describes the preferred embodiment with reference to the attached drawings. However, various modifications and corrections are obvious for those skilled in this art. It should be understood that such modifications and corrections are included in the scope of the present disclosure unless the modifications and corrections are out of the scope specified by the attached claims.

The invention claimed is:

1. A railcar comprising:

a buffer installed in an end portion of each of coupled cars, and urging each other in a car longitudinal direction, the buffer having a stem movable in the car longitudinal direction and a spring urging the stem;

an underframe internally enclosing part of the buffer and including an opening on a top plate of the underframe; and a compression mechanism forcibly compressing the spring to move the stem, part of the compression mechanism being freely brought into and out of the opening.

2. The railcar according to claim 1, further comprising:

a gangway footplate serving as a passage between the coupled cars; and a buffer plate overlapping the gangway footplate and being abutted with the adjacent car, wherein the buffer presses the buffer plate in the car longitudinal direction.

3. The railcar according to claim 1, wherein the buffer includes:

the spring positioned coaxial to the stem;

a spring receiving member fixed to the stem and supporting one end of the spring; and a housing member remaining stationary with respect to the movable stem and supporting the other end of the spring, wherein the compression mechanism includes:

a first fastening member fixed to the housing member;

a second fastening member engaged with the first fastening member; and a holding portion provided in the spring receiving member and holding the second fastening member or the first fastening member, and wherein by tightening the first fastening member and the second fastening member, the spring receiving member and the stem are moved together to compress the spring.

4. The railcar according to claim 1, further comprising:

a displacement preventing member preventing a buffer rear end portion from displacing toward the top plate, the displacement preventing member being fixed to the underframe and extending to the buffer rear end portion, with the buffer installed in the end portion of the car.

5. The railcar according to claim 1, wherein the opening is positioned at a front side of the stem in the underframe and formed on an upper surface of the top plate, and wherein the underframe includes a non-contact space where there is no member arranged in contact with a buffer rear end portion when the buffer protrudes from the opening.

6. The railcar according to claim 3, wherein the first fastening member is a nut, and the second fastening member is a bolt extending in parallel to the spring, and wherein the holding portion is a groove receiving the bolt.

* * * * *